US005241904A

United States Patent [19]

Kobayashi et al.

[11] Patent Number: 5,241,904

[45] Date of Patent: Sep. 7, 1993

[54] DOT LIKE PRINTER EMPLOYING OVERLAPPED CURRENT APPLYING SEQUENCE TO COILS OF DIFFERENT GROUPS

[75] Inventors: Hirotaka Kobayashi; Shigenori Suematsu; Yoshikane Matsumoto; Shozo Ishii, all of Katsuta, Japan

[73] Assignee: Hitachi Koki Co., Ltd., Tokyo, Japan

[21] Appl. No.: 599,170

[22] Filed: Oct. 17, 1990

[30] Foreign Application Priority Data

Oct. 20, 1989 [JP] Japan ..... 1-274506

[51] Int. Cl.[5] ..... B41J 2/515

[52] U.S. Cl. ..... 101/93.04; 361/168.1; 101/93.29

[58] Field of Search ..... 101/93.04, 93.05, 93.29; 400/121, 124, 157.2; 361/152, 153, 159, 160, 166, 167, 168.1, 169.1

[56] References Cited

U.S. PATENT DOCUMENTS

| | | | |
|---|---|---|---|
| 4,386,563 | 6/1983 | Farb | 101/93.04 |
| 4,473,311 | 9/1984 | Sakaida | 400/124 |
| 4,550,659 | 11/1985 | Yamanaga | 101/93.04 |
| 4,627,344 | 12/1986 | Costello | 101/93.29 |
| 4,936,210 | 6/1990 | Ukai | 101/93.04 |

FOREIGN PATENT DOCUMENTS

| | | | |
|---|---|---|---|
| 90384 | 12/1978 | Japan | 101/93.29 |
| 225768 | 11/1985 | Japan | 400/124 |
| 174166 | 7/1987 | Japan | 400/124 |
| 159060 | 7/1988 | Japan | 400/124 |

*Primary Examiner*—David A. Wiecking

*Attorney, Agent, or Firm*—Sughrue, Mion, Zinn, Macpeak & Seas

[57] ABSTRACT

A dot line printer for carrying out printing on a print paper while shuttling a hammer bank back and forth in a direction to traverse the print paper. To lower the peak level of the current flowed in an electromagnetic coil provided in association with a print hammer and to reduce an electric power consumption, a predetermined number of print hammers are divided, for example, into four groups A, B, C and D. The print hammers belonging to group A are arranged at a constant interval wherein three print hammers belonging to groups B, C and D are interposed between adjacent two print hammers of group A and are disposed in positions displaced toward the leftside group A hammer from their home positions defined by equally spaced apart positions between the adjacent two print hammers of group A. Currents are adapted to flow in the coils of the print hammers belonging to different groups, e.g., A and B, in overlapped relation to each other, whereby the levels of the currents flowed therein are lowered due to magnetic interaction by the coils of another group.

4 Claims, 6 Drawing Sheets

DOT LIKE PRINTER EMPLOYING OVERLAPPED CURRENT APPLYING SEQUENCE TO COILS OF DIFFERENT GROUPS

BACKGROUND OF THE INVENTION

The present invention relates to a dot line printer which carries out printing on a print sheet while shuttling a hammer bank back and forth in a direction transverse to the print paper.

Dot line printers include a hammer bank wherein a plurality of dot print hammers are juxtaposed along a print line. Each print hammer is made up of an elongated leaf spring having one end to which a dot pin is attached and another end secured to a mounting plate. The upper portion of the print hammer is held in a retracted position by a magnetic attraction of a permanent magnet and is fired or released therefrom by supplying a pulsating current to an electromagnetic coil wound around the pole of a rear yoke, thereby making a dot impression on a print paper through an ink ribbon.

In such dot line printers, it is not desirable to simultaneously fire two adjacent print hammers. Because, in order for adjacent print hammers to be fired simultaneously, it is necessary that the duration of the pulsating currents, supplied to the electromagnetic coils, be prolonged and/or the peak levels thereof be raised. Japanese Patent Publication (Kokoku) No. 55-10385 discloses a printer of the type wherein print hammers impinge against print types (characters and symbols) embossed on a rotating drum to thus print characters and/or symbols on a print paper, in which it is proposed to displace the positions of the print types in the circumferential direction of the drum from their home positions. By the displacement of the print type positions, the adjacent hammers are not fired simultaneously.

With respect to the dot line printers to which the present invention pertains, U.S. Pat. No. 4,386,563 (corresponding to DE-OS 3,223,274) and U.S. Pat. No. 4,550,659 disclose dividing the dot print hammers into two groups and displacing the respective hammer positions of the second group by a distance corresponding to a half of a dot from their home positions. A half of a dot is herein defined by a half of a reciprocal of a print density which is defined by a number of dots per a unit length (inch). With such arrangement of the hammers, the number of the hammers which are fired simultaneously is reduced. Undue electric power consumption is avoided and the peak level of the pulsating current does not need to be raised, thereby allowing to use a compact-size power supply unit.

However, such technique is not effective for high speed dot line printers having a printing capability of, for example, about 500 lines per minute for the printing of Japanese Kanji characters. To increase the printing speed, an increased number of the hammers must be provided. The number of the simultaneously fired hammers is, however, increased as the number of the hammers is increased. In the case of 300 hammers, half of them may possibly be fired simultaneously. Hence, the electric power consumption is increased because of the increase of the simultaneously fired hammers.

Further, if dot line printers are designed so that the second half of the hammers displaced by a half of the dot from their home positions are allowed to be fired simultaneously with the firing of the first half of the hammers, the dot impressions are further made by the second half of the hammers in positions between two successive dots impressed by the first half of the hammers. Although high quality printing can be accomplished, an increase of the electric power consumption results.

SUMMARY OF THE INVENTION

The present invention has been made to solve the aforementioned problems and accordingly it is an object of the present invention to provide a dot line printer wherein a level of the current flowed in an electromagnetic coil is lowered to thereby reduce the electric power consumption.

Briefly, in accordance with the present invention, currents are flowed in the coils of print hammers belonging to different groups in overlapped relation in view of the fact that the current flowing in each of the coils is reduced by a magnetic interaction.

According to the present invention, there is provided a dot line printer for carrying out printing on a print paper with a print density defined by a number of dots per a unit length while intermittently feeding a print paper in a first direction. The printer has a hammer bank that is reciprocally movable along a line extending in a second direction perpendicular to the first direction. A mounting plate is fixedly mounted on the hammer bank, and a set of print hammer assemblies are mounted on the hammer bank, including a predetermined number of print hammers. Each print hammer has an elongated leaf spring having one end to which a dot pin is attached and another end secured to the mounting plate. The print hammers are divided into N number of groups wherein N is an integer equal to or greater than two. Print hammers belonging to one group are arranged at a constant interval wherein (N−1) number of the print hammers belonging to remaining (N−1) groups are interposed between adjacent two print hammers of the one group in a predetermined order and are disposed in positions displaced in the second direction from their home positions defined by equally spaced apart positions one from the other between the adjacent two print hammers of the one group. Magnets are provided in association with the print hammers for magnetically attracting the print hammers to predetermined positions, and a plurality of coils are provided in one-to-one correspondence to the print hammers for releasing the print hammers from the magnets so as to make dot impressions on the print paper when currents are flowed in the coils. A driver means is provided for selectively flowing the currents in the coils. The currents are adapted to flow in the coils of the print hammers belonging to different groups in overlapped relation.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENTS

Preferred embodiments of the present invention will now be described with reference to the accompanying drawings. In the following description, the expressions "front", "rear", "upper", "lower", "right" and "left" are used throughout the description to define various parts when the dot line printer is disposed in an orientation in which it is intended to be used.

Figure 1:
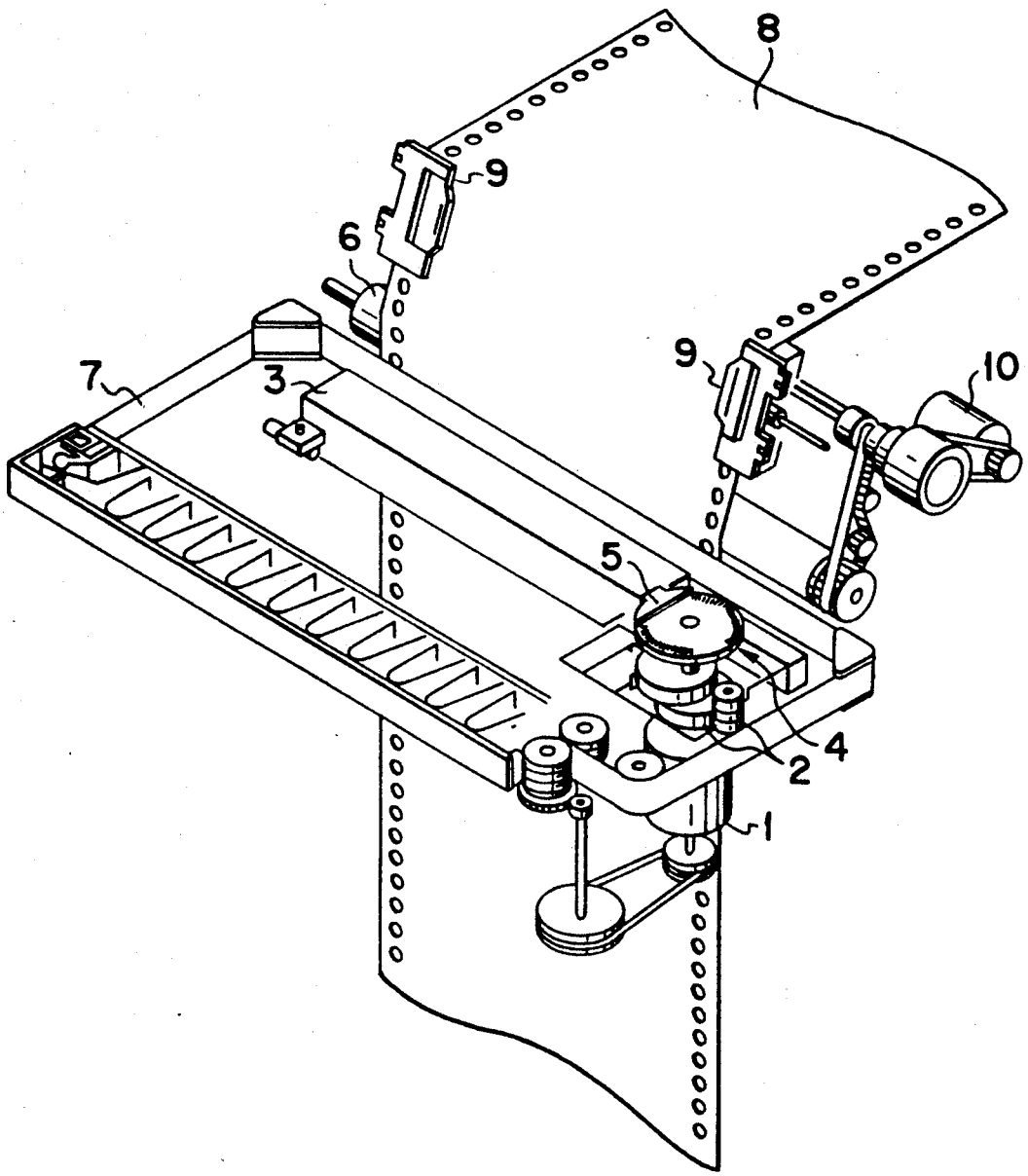
FIG. 1 is a schematic diagram showing an example of a dot line printer.

The dot line printer according to the present invention has an arrangement as shown in FIG. 1. Although not illustrated in FIG. 1, a predetermined number of print hammers are accommodated in a hammer bank 3. The hammer bank 3 is driven by a shuttle motor 1 through a cam 2 and is reciprocated along a print line with a single rotation of the motor 1. A rotary encoder 4 formed with a predetermined number of angularly spaced slits is mounted on a cam shaft. A photocoupler 5 consisting of a light emitting diode and a photodiode is disposed in association with the rotary encoder 4 for detecting an angular movement of the rotary encoder 4.

A platen 6 is rotatably supported on a printer frame (not shown) for supporting the print paper 8 thereon. A pair of pin tractors 9 are disposed in side marginal portions of the print paper 8, which upon engaging perforations formed on two sides of the print paper 8, train the print paper 8 while cooperating with the platen 6. The print paper 8 is fed intermittently in a direction perpendicular to the direction in which the hammer bank 3 reciprocates. Both the platen 6 and the pin tractors 9 are driven by a paper feed motor 10.

Figure 2:
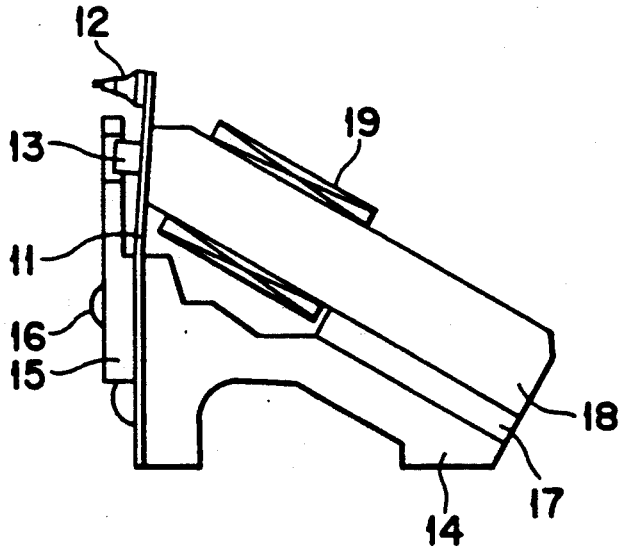
FIG. 2 is a side elevational view showing a print hammer and its driver unit.

As shown in FIG. 2, the print hammer 11 is in the form of an elongated leaf spring having an upper end to which a dot pin 12 is attached and a lower end fixedly secured through a front yoke 15 to a mounting plate 14 by a screw 16. A plunger 13 is also attached to the upper portion of the leaf spring. In association with each print hammer 11, there are provided a permanent magnet 17, a yoke 18, and an electromagnetic coil 19 wound around the yoke 18. The magnet 17 and the yoke 18 are elongated plate like members both extending in the direction parallel to the print line or perpendicular to the sheet of drawing so as to be commonly used by the plurality of print hammers 11. The upper portion of the hammer 11 is magnetically attracted to the pole of the yoke 18 and is released therefrom in response to the energization of the coil 19. The dot pin 12 thus strikes the print paper 8 through the ink ribbon 7, thereby making an impression of a dot on the paper 8.

Figure 3:
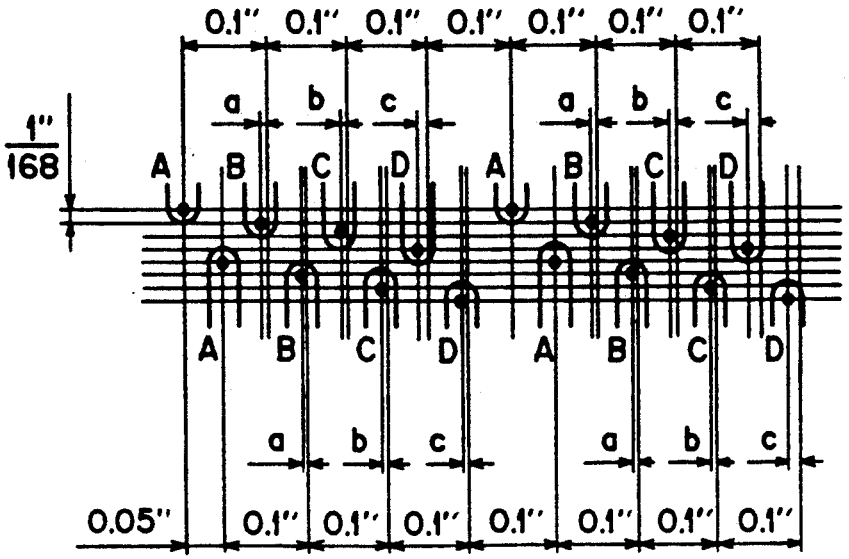
FIG. 3 is a front view showing an arrangement of the print hammers according to one embodiment of the present invention.

FIG. 3 shows an arrangement of the print hammers 11 wherein 8 dot lines can simultaneously be printed with one scan of the hammer bank 3. One scan of the hammer bank 3 is herein defined by the movement of the hammer bank 3 from the leftmost to the rightmost positions or vice versa. The print hammers 11 are arranged so that the free ends of a half of the print hammers 11 extend downwardly whereas the free ends of another half thereof extend upwardly. The upper and lower print hammers 11 are arranged alternately. The hammers 11 are divided into four groups A through D. Each print hammer 11 is labeled with one of the letters A, B, C and D to indicate the group to which the print hammer 11 belongs. The group A hammers of the upper half are aligned to print the first dot line. Similarly, with respect to the upper half of the hammers, those belonging to groups B, C and D are respectively aligned to print the second, third and forth dot lines. The group A hammers of the lower half are aligned to print the fifth dot line, and those belonging to groups B, C and D are respectively aligned to print the sixth, seventh and eighth dot lines.

With reference to the upper half of the hammers 11, those belonging to group A are arranged at a constant interval of 0.4 ($=0.1\times4$) inch. Three hammers belonging to groups B, C and D are interposed between adjacent two print hammers of group A. A hammer 11 belonging to group B is disposed next to the leftside hammer of group A but is displaced leftwardly by a distance a corresponding to a quarter of a dot ($a=(1/160)\times\frac{1}{4}$ inch) from its home position rightwardly spaced apart by 0.1 inch from the position of the leftside hammer of group A. Note that a print density in the print line direction or horizontal direction is assumed to be 160 dpi (dots per inch) and that in the paper feeding direction or vertical direction is 160 dpi. A hammer 11 belonging to group C is disposed next to the group B hammer but is displaced leftwardly by a distance b corresponding to two quarters of a dot ($b=(1/160)\times2/4$ inch) from its home position rightwardly spaced apart by 0.2 inch from the position of the leftside hammer of group A. Likewise, a hammer 11 belonging to group D is disposed next to the group C hammer but is displaced leftwardly by a distance c corresponding to three quarters of a dot ($c=(1/160)\times\frac{3}{4}$) from its home position rightwardly spaced apart by 0.3 inch from the position of the leftside hammer of group A.

In the rightward scan of the hammer bank 3, the print hammers of groups A, B, C and D are sequentially fired in the stated order whereas in the leftward scan of the hammer bank 3, the hammers of groups D, C, B and A are sequentially fired in the stated order.

Figure 4:
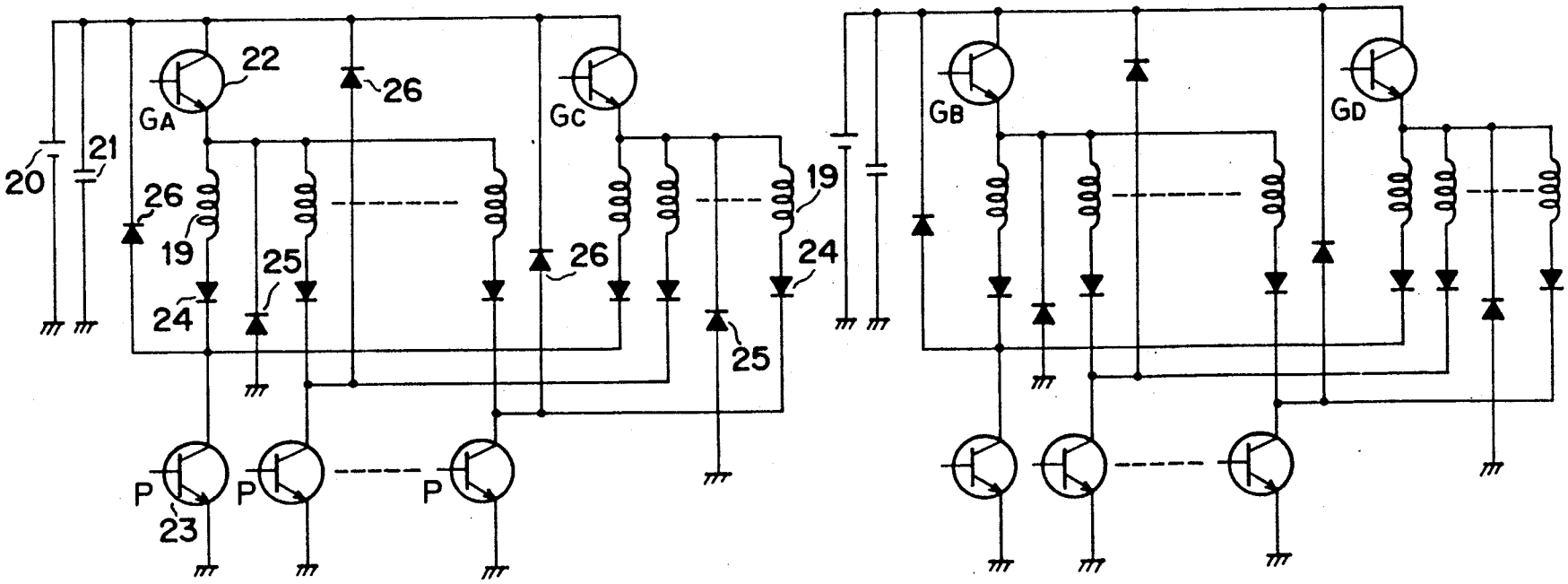
FIG. 4 is a circuit diagram showing an example of an electromagnetic coil driver circuit.

FIG. 4 shows two identical driver circuits, one for driving the hammers 11 belonging to groups A and C and the other for driving the hammers 11 belonging to groups B and D. For the sake of simplicity, only one of the driver circuits will be described.

The driver circuit includes a power supply 20 and a capacitor 21 connected thereacross. The circuit further includes a predetermined number of data control transistors 23 equal to the number of the hammers contained in each group. The coils 19 provided in association with the group A hammers have first ends connected in one-to-one correspondence to the data control transistors 23 through reverse-flow blocking diodes 24 in one-to-one correspondence. The coils 19 provided in association with the group C hammers are also connected to the same data control transistors 23 through the reverse-flow blocking diodes 24 in the similar fashion. The data control transistors 23 are rendered conductive in response to print data signals P applied to the bases thereof. Second ends of the coils 19 of groups A and C are connected through the respective group control transistors 22 to the power supply source 20. The group control transistors 22 are rendered conductive in response to group control signals $G_A$, $G_C$ applied to the respective bases thereof.

A flyback diode 25 is provided to each of the groups and is connected between the second ends of the coils 19 of each group and ground. Flyback diodes 26 are provided in one-to-one correspondence to the coils 19 of each group, and the anodes thereof are connected to the first ends of the coils 19 through the diodes 24 and the cathodes thereof are connected to the power supply source 20.

Operation of the thus configured circuit will be described with reference to the waveform diagram shown in FIG. 5. In the following description, it is assumed that the repeatability of the hammer is 400 microseconds, which is defined by a duration from the time at which a release current is supplied to the coil 19 to release the hammer from the pole of the yoke 18 until the time at which the hammer is again magnetically held on the pole of the yoke 18 after making a dot impression on the print paper 8.

Figure 5:
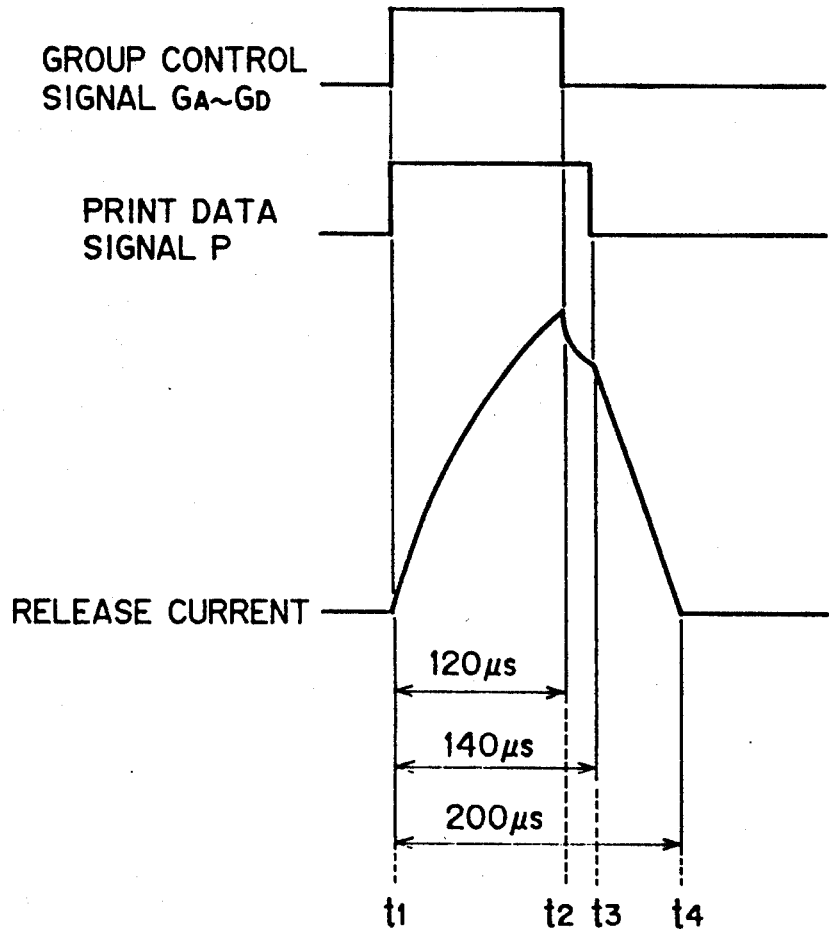
FIG. 5 is a waveform diagram showing waveforms of a group control signal, a print data signal and a current flowing in the electromagnetic coil.

As shown in FIG. 5, the duration of each of the group control signals $G_A$ through $G_D$ and that of the print data signal P are set to 120 and 140 microseconds, respectively. The rising edges of the two signals $G_A$ and P are in coincidence with each other at time instant $t_1$. Accordingly, a current flows in the group A coil 19 for a duration of 120 microseconds. At time instant $t_2$, the group A control transistor 22 is rendered non-conductive, so that a flyback current flows in the coil 19 through the data control transistors 23 and the diode 25. At the time instant $t_3$, the data control transistor 23 is rendered non-conductive. Then, a flyback current again flows in the coil 19 through a path including the coil 19, and the diodes 24, 26 and 25. In this manner, the release current flows in the coil 10 for a duration of about 200 microseconds from the time instant $t_1$ to $t_4$.

In the above description, although the durations of the group control signals $G_A$ through $G_D$ and the print data signals P are set to 120 and 140 microseconds, respectively, they may be set to a reverse relation, i.e., to 140 and 120 microseconds. In such a case, the connections of the flyback diodes 25, 26 need to be modified.

Figure 6A:
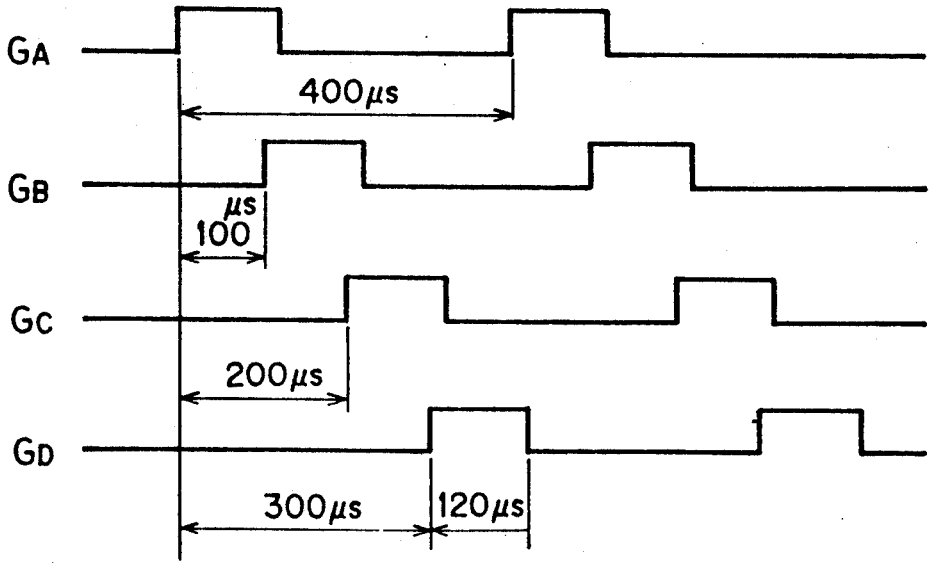
FIG. 6A is a timing chart showing group control signals applied to electromagnetic coil driving transistors according to one embodiment of the present invention.

FIG. 6A is a timing chart showing the occurrences of the four group control signals $G_A$ through $G_D$. Each group control signal is produced for a duration of 120 microseconds at a regular interval of 400 microseconds. The group control signals $G_A$ through $G_D$ are successively produced at an interval of 100 microseconds. As described, the release current flows in the coil for a duration of 200 microseconds, so that the rising edge of the release current flowing in the coil of the group B hammer precedes the falling edge of the release current flowing in the group A coil. That is, there exists an overlapped period between the release currents flowing in the two hammers belonging to different groups.

The experiments conducted by the present inventors have proven the following advantages by the overlapped current applying sequence as described above.

Figure 6B:
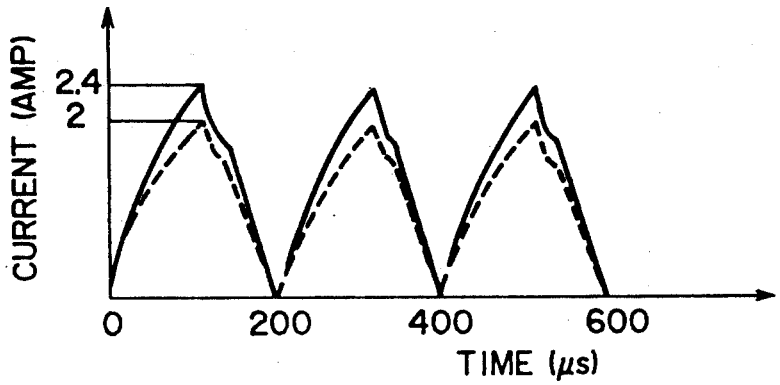
FIG. 6B is a waveform diagram of a current flowing in the electromagnetic coil according to a non-overlapped current applying sequence.

According to a conventional non-overlapped current applying sequence, when successively arranged 6 hammers of group A are simultaneously fired and thereafter another 6 hammers of group C which are also successively arranged are simultaneously fired, the release current having a waveform indicated by a solid line in FIG. 6B flows in each of the coils of the group A hammers for the duration of 200 microseconds. Immediately thereafter, the release current having the same waveform flows in each of the coils of the group C hammers for the duration of another 200 microseconds. Due to the simultaneous firing of the 6 hammers of each group, the peak level of the release current is high in comparison with the peak level when a single hammer of one group is fired. The waveform of the latter case is indicated by a dotted line in FIG. 6B. The former and latter peak levels are 2.4 and 2 ampere, respectively, and the electric power consumption in the former case is about 1.26 times as large as that in the latter case.

Figure 6C:
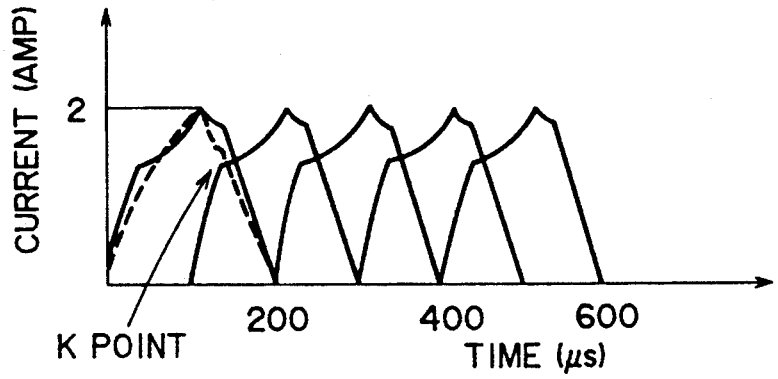
FIG. 6C is a waveform diagram of a current flowing in the electromagnetic coil according to an overlapped current applying sequence.

On the other hand, in the case of the overlapped current applying sequence according to the present invention, when the successively arranged 6 hammers of each of the groups A through D are fired simultaneously, the waveform of the release current flowing in each coil is as shown by a solid line in FIG. 6C. Notwithstanding the fact that the 6 hammers are simultaneously fired, the peak level of the release current is 2 ampere equal to that of the release current measured when a single hammer is fired by the conventional non-overlapped current applying sequence. Moreover, the increase of the electric power consumption per one coil is only about 1.12 times with respect to the case wherein a single hammer is fired according to the conventional non-overlapped current applying sequence.

While description has been made with respect to the case where 6 hammers in each group are simultaneously fired, the inventors noted that as the number of the hammers to be fired simultaneously increases, greater advantages can be obtained in terms of the peak level of the release current and the electric power consumption. According to the conventional non-overlapped current applying sequence, both the peak level of the current and the electric power consumption increase attendant to the increase of the number of the hammers to be simultaneously fired. In contrast, according to the overlapped current apply sequence of the present invention, there is no substantial increase of the level of the current and the power consumption.

The reason that the peak level of the release current is lowered will be described with respect to the second group hammers.

After elapsing 100 microseconds from the firing of the group A hammer, the group control signal $G_B$ is produced. 40 microseconds thereafter (K point in FIG. 6C), the print data signal P for the group A hammer disappears, whereby the current flowing in the group A coil is abruptly lowered. Due to the change of the magnetic flux attendant to the lowering of the current flowing therein, a voltage is induced across the adjacent group B coil. The voltage induced thereacross causes a braking of the rising inclination of the current flowing in the group B coil after K point.

At the time when the current flowing in the group A coil becomes zero, the current starts flowing in the group C coil, so that a voltage is induced across the adjacent coil of group B causing an increase in the current flowing therein. Therefore, the current flowing therein abruptly increases for a brief period of time but gradually decreases and finally becomes zero as the group control signal $G_B$ and the print data signal P disappear one after another.

Figure 7:
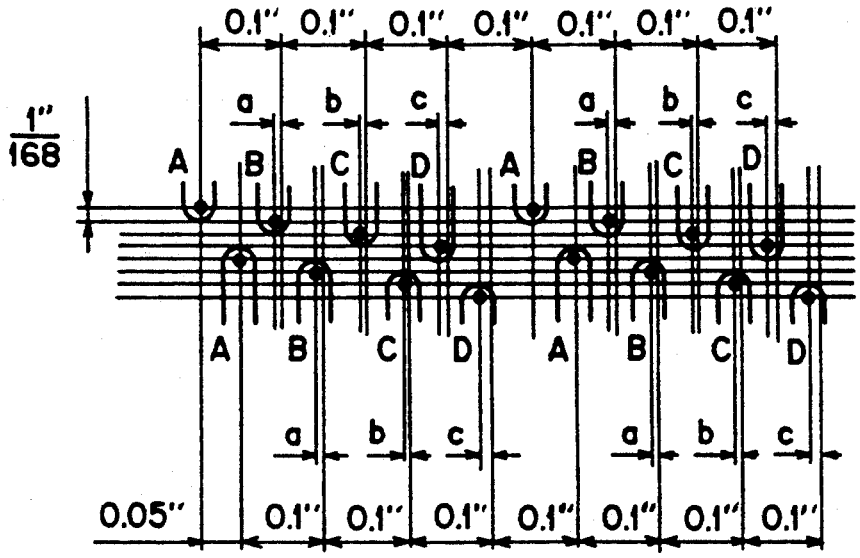
FIG. 7 is a front view showing an arrangement of the print hammers according to another embodiment of the present invention.

FIG. 7 shows an arrangement of the print hammers according to a second embodiment of the present invention. The arrangement thereof is similar to that shown in FIG. 3 but differs therefrom in that the print hammers belonging to groups B and C are displaced from their home positions by $a=(1/160)\times 2/4$ and $b=(1/160)\times \frac{1}{4}$, respectively, toward the leftside group A hammer. Similar to the arrangement shown in FIG. 3, the group D hammers are displaced from their home positions by $c=(1/160)\times \frac{3}{4}$ toward the leftside group A hammer. Accordingly, in the rightward scan of the hammer bank 3, the hammers belonging to groups A, C, B and D are sequentially fired in the stated order, whereas in the leftward scan of the hammer bank 3, the hammers belonging to groups D, B, C and A are sequentially fired in the stated order. According to such an arrangement, the number of adjacent hammers of different groups which are to be fired in overlapped relation is reduced in comparison with the embodiment described with reference to FIG. 3.

Figure 8:
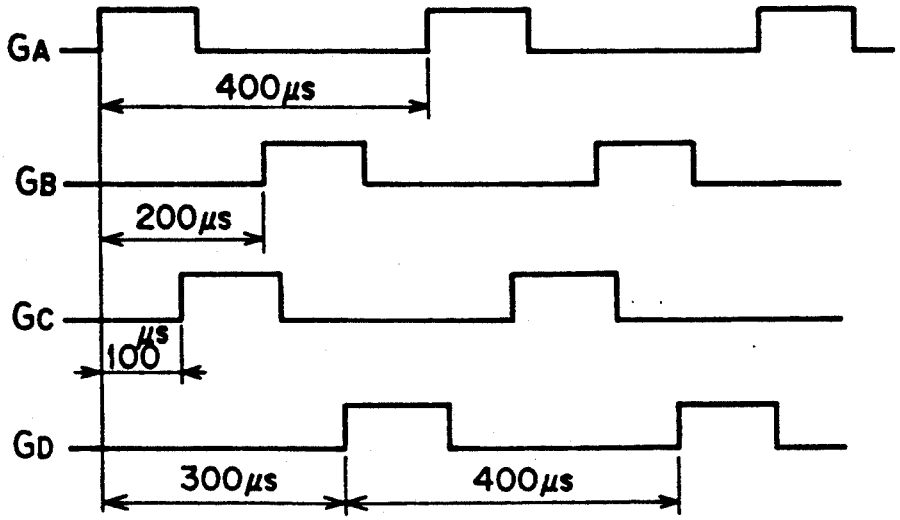
FIG. 8 is a timing chart showing the group control signal applied to electromagnetic coil driving transistors according to another embodiment of the present invention.

FIG. 8 is a timing chart showing the timings of the group control signals $G_A$ through $G_D$ applied to the corresponding group control transistors in the case where the hammers are arranged as shown in FIG. 7. Due to the reduced number of adjacent group coils to which the currents are flowed in overlapped relation, advantageous effects can further be obtained such that the delays of both the flight time and the repeatability caused by the current flow in the adjacent coil can be minimized.

It should be noted that when the hammers arranged as in FIG. 7 are fired in accordance with the group control signals shown in FIG. 8, it is necessary that the group control signals $G_B$ and $G_C$ appearing in the circuit diagram of FIG. 4 be changed over, i.e., the group control signal $G_B$ in FIG. 4 be changed to $G_C$ and vice versa.

Although the present invention has been described with reference to specific embodiments, it would be apparent to those skilled in the art that a variety of changes and modifications may be made without departing from the scope and spirit of the invention. For example, while the dot density has been described as being 160 dpi, the present invention is applicable even when the dot density is set to different values. Further, according to the present invention, the print hammers can generally be divided into N groups where N is an integer equal to or greater than two (2).

In the embodiment described, the dot pins of the print hammers belonging to same group are arranged to make dot impressions on a same dot line at the time of one way movement of the hammer bank. However, the dot pin positions can be arbitrarily arranged to made the dot impressions on not only the same dot line but also different dot lines particularly when the line directional print density is set to different values. Further, in the foregoing description, the dot pins of the print hammers contained in any one group are positioned at positions displaced in the paper feeding direction from positions of the dot pins of remaining one of the groups by one dot line, whereby N dot lines are simultaneously printed at the time of one way movement of the hammer bank. However, the number of the dot lines which can be simultaneously printed is not necessarily N if the arrangement of the dot pin positions is modified depending upon the print density.

What is claimed is:

1. A dot line printer for carrying out printing on a print paper while intermittently feeding a print paper in a first direction, comprising:

a plurality of print hammers juxtaposed along a line extending in a second direction perpendicular to said first direction, said print hammers being divided into N number of groups wherein N is an integer equal to or greater than two, the print hammers belonging to one group being arranged at a constant interval wherein (N−1)number of the print hammers belonging to the remaining (N−1) groups are interdigitated with the print hammers of said one group in a predetermined order and are disposed in positions displaced in the second direction from their home positions, said home positions defined by equidistant positions between the adjacent two print hammers of said one group;

magnets provided in association with said print hammers for magnetically attracting said print hammers to predetermined positions;

a plurality of coils provided in one-to-one correspondence with each of said print hammers, respective ones of said print hammers being released from said predetermined positions when a current having a predetermined duration flows in said coils corresponding to said print hammers, thereby making dot impressions on the print paper;

a hammer bank reciprocally movable along said line, said hammer bank accommodating said plurality of print hammers;

N number of group control means connected one-to-one correspondence with each of said N number of groups into which said print hammers are divided, for applying a group control signal to each of said N number of groups, said group control signal having a first predetermined duration; and a plurality of print signal applying means connected in one-to-one correspondence with each of said plurality of coils, for applying a print signal to each of said plurality of coils, said print signal having a second predetermined duration;

said current flowing in each of said coils being controlled by corresponding ones of said group control signals and print signals, and before expiration of any one of said first and second predetermined durations of said group control signals and said print signals, a subsequent group control signal is applied to another of said groups of said print hammers.

2. A dot line printer according to claim 1, wherein N is equal to four.

3. A dot line printer according to claim 1, wherein the displacements of said hammers belonging to any one of the remaining (N−1) of said groups are determined by $(1/D)\times n/N$ wherein D is the print density and n is an integer ranging from 1 to (N−1) and specific to any one of said remaining (N−1) groups.

4. A dot line printer according to claim 1, wherein said plurality of print hammers constitutes a set of print hammer assemblies, said printer further comprising:

another set of print hammers assemblies mounted on said hammer bank and including an equal predetermined number of print hammers corresponding to those included in said set of print hammer assemblies, said another set of print hammer assemblies being divided into said N number of groups, the print hammers of said set of print hammer assemblies and the corresponding print hammers of said another set of print hammer assemblies being arranged alternately in the second direction, each print hammer of said another set of print hammer assemblies comprising an elongated leaf spring having one end to which a dot pin is attached and another end secured to said mounting plate;

further magnets provided corresponding to said print hammers of said another set of print hammer assemblies for magnetically attracting said print hammer to second predetermined positions;

a further plurality of coils provided in one-to-one correspondence to said print hammers of said another set of print hammer assemblies for releasing said print hammers of said another set of print hammer assemblies from the second predetermined positions to make dot impressions on the print paper when currents are directed to said another equal plurality of coils.

* * * * *